US010986920B1

(12) United States Patent
Huang

(10) Patent No.: US 10,986,920 B1
(45) Date of Patent: Apr. 27, 2021

(54) APPARATUS FOR ATTACHING AN INCLINATION-MONITORING DEVICE TO A TABLE

(71) Applicant: TCT NANOTEC CO., LTD., Taichung (TW)

(72) Inventor: Chi-Wei Huang, Taichung (TW)

(73) Assignee: TCT NANOTEC CO., LTD., Taichung (TW)

( * ) Notice: Subject to any disclaimer, the term of this patent is extended or adjusted under 35 U.S.C. 154(b) by 0 days.

(21) Appl. No.: 16/895,020

(22) Filed: Jun. 8, 2020

(51) Int. Cl.
*A47B 21/02* (2006.01)
*A47B 13/08* (2006.01)
*A47B 17/02* (2006.01)

(52) U.S. Cl.
CPC ..... *A47B 21/02* (2013.01); *A47B 13/081* (2013.01); *A47B 17/02* (2013.01); *A47B 2200/0043* (2013.01); *A47B 2200/0056* (2013.01)

(58) Field of Classification Search
CPC .... A47B 2200/0046; A47B 2200/0056; A47B 2200/0066; A47B 2200/008
USPC ..... 108/1, 7, 9, 6, 50.01, 50.02, 147
See application file for complete search history.

(56) References Cited

U.S. PATENT DOCUMENTS 5,461,974 A * 10/1995 Reneau ..... A47B 9/04 108/147
6,550,401 B2 * 4/2003 Chiba ..... B23Q 1/25 108/20
6,796,247 B1 * 9/2004 Iglseder ..... G06K 7/10336 108/50.01
7,100,516 B2 * 9/2006 Riddiford ..... A47B 21/00 108/50.01
7,953,509 B2 * 5/2011 Murayama ..... B66C 1/0243 700/114
8,935,985 B2 * 1/2015 Hjelm ..... A47B 21/06 108/50.01
9,612,849 B1 * 4/2017 Gildein, II ..... H04L 67/34
9,655,438 B1 * 5/2017 Shoenfeld ..... A47B 21/02
2005/0217540 A1 * 10/2005 Novak ..... A47B 83/001 108/50.01

(Continued)

FOREIGN PATENT DOCUMENTS

EP 3461369 A1 * 4/2019 ..... G05B 19/416
TW M576412 U 4/2019

(Continued)

*Primary Examiner* — Jose V Chen
(74) *Attorney, Agent, or Firm* — Alan D. Kamrath; Karin L. Williams; Mayer & Williams PC

(57) ABSTRACT

A table assembly includes tiltable board, an inclination-monitoring module and an attaching apparatus. The inclination-monitor device includes an electronic module and a power supply. The electronic module includes a sensor for detecting the inclination of the tiltable board and a display for showing the inclination. The power supply includes a battery, a holder and a cover. The battery is located in the holder and electrically connected to the electronic module. The cover is engaged with the holder to keep the battery in the holder. The attaching apparatus includes a shell, an upper frame and a lower frame. The shell is located in a bore made in the tiltable board, and receives the inclination-monitoring device. The upper frame extends on the shell, contacts an upper face of the tiltable table, and includes a window to expose the display. The lower frame covers the holder.

7 Claims, 9 Drawing Sheets

(56) References Cited

U.S. PATENT DOCUMENTS

| | | | | |
|---|---|---|---|---|
| 2006/0137577 | A1* | 6/2006 | Chang | A61B 5/704 108/7 |
| 2014/0285959 | A1* | 9/2014 | Riley | A47C 7/72 361/679.08 |
| 2016/0231731 | A1* | 8/2016 | Carver | A47B 21/00 |
| 2017/0000254 | A1* | 1/2017 | Matlin | A47B 9/02 |
| 2017/0135587 | A1* | 5/2017 | Desroches | A61B 5/14551 |
| 2017/0354244 | A1* | 12/2017 | Lee | A47B 37/00 |
| 2018/0120790 | A1* | 5/2018 | Hansen | G05B 19/0423 |
| 2018/0279770 | A1* | 10/2018 | Crowe | A47B 9/10 |
| 2018/0338608 | A1* | 11/2018 | Keller | A47B 9/20 |
| 2018/0360208 | A1* | 12/2018 | Liao | A47B 13/00 |
| 2019/0029412 | A1* | 1/2019 | Gibson | H04Q 9/04 |
| 2019/0038017 | A1* | 2/2019 | Platzer | A47B 9/20 |
| 2019/0214120 | A1* | 7/2019 | Hoffman | A47B 9/00 |
| 2019/0328129 | A1* | 10/2019 | Namala | A47B 9/16 |
| 2019/0369578 | A1* | 12/2019 | Xiang | A47B 21/02 |
| 2020/0104762 | A1* | 4/2020 | Gibson | A47C 7/72 |
| 2020/0146440 | A1* | 5/2020 | Fogarty | A47B 13/06 |
| 2020/0154881 | A1* | 5/2020 | Applegate | A47B 3/0815 |
| 2020/0170407 | A1* | 6/2020 | Knapp | A47B 9/20 |
| 2020/0221863 | A1* | 7/2020 | Laing | A47B 9/04 |
| 2020/0268144 | A1* | 8/2020 | Mehandjiysky | A47B 21/03 |
| 2020/0329860 | A1* | 10/2020 | Xiang | A47B 9/20 |

FOREIGN PATENT DOCUMENTS

| | | | | |
|---|---|---|---|---|
| WO | WO-2018012526 | A1 * | 1/2018 | A47B 9/20 |
| WO | WO-2020083432 | A1 * | 4/2020 | A47C 31/126 |

* cited by examiner

APPARATUS FOR ATTACHING AN INCLINATION-MONITORING DEVICE TO A TABLE

BACKGROUND OF INVENTION

1. Field of Invention

The present invention relates to control over inclination of a table and, more particularly, to an apparatus for attaching an inclination-monitoring device to a table.

2. Related Prior Art

Taiwanese Patent No. M576412U discloses a device for controlling inclination of a tilt-able board of a table assembly. The inclination-controlling device includes a gyro, a display and a controller. The gyro detects the inclination of the tiltable board. The display shows the inclination of the tiltable board. A user operates the controller to adjust the inclination of the tiltable board. While the inclination of the tiltable board is being changed, the gyro detects the inclination of the tiltable board and sends a signal about the inclination. The controller receives the signal and instructs the display to show the inclination. However, not much is discussed about how to attach the inclination-controlling device to the tiltable board.

The present invention is therefore intended to obviate or at least alleviate the problems encountered in prior art.

SUMMARY OF INVENTION

It is the primary objective of the present invention to provide an attaching apparatus for attaching an inclination-controlling device to a tiltable board.

To achieve the foregoing objective, the tiltable board includes an upper face, a lower face and a bore. The inclination-monitor device includes an electronic module and a power supply. The electronic module includes a sensor and a display. The sensor detects the inclination of the tiltable board, and accordingly sends a signal. The display receives the signal, and accordingly shows the inclination of the tiltable board. The power supply includes a battery, a holder and a cover. The holder includes a recess. The battery is located in the recess and electrically connected to the electronic module. The cover is engaged with the holder to keep the battery in the recess. The attaching apparatus includes a shell, an upper frame and a lower frame. The shell is located in the bore and formed with a chamber for receiving the inclination-monitoring device. The upper frame extends on the shell, contacts the upper face of the tiltable table, and includes a window in communication with the chamber so that the display is exposed by the window. The lower frame covers the holder and a portion of the lower face of the tiltable board around the bore, and includes an opening in communication with the recess to allow smooth movement of the battery into or from the recess via the opening.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
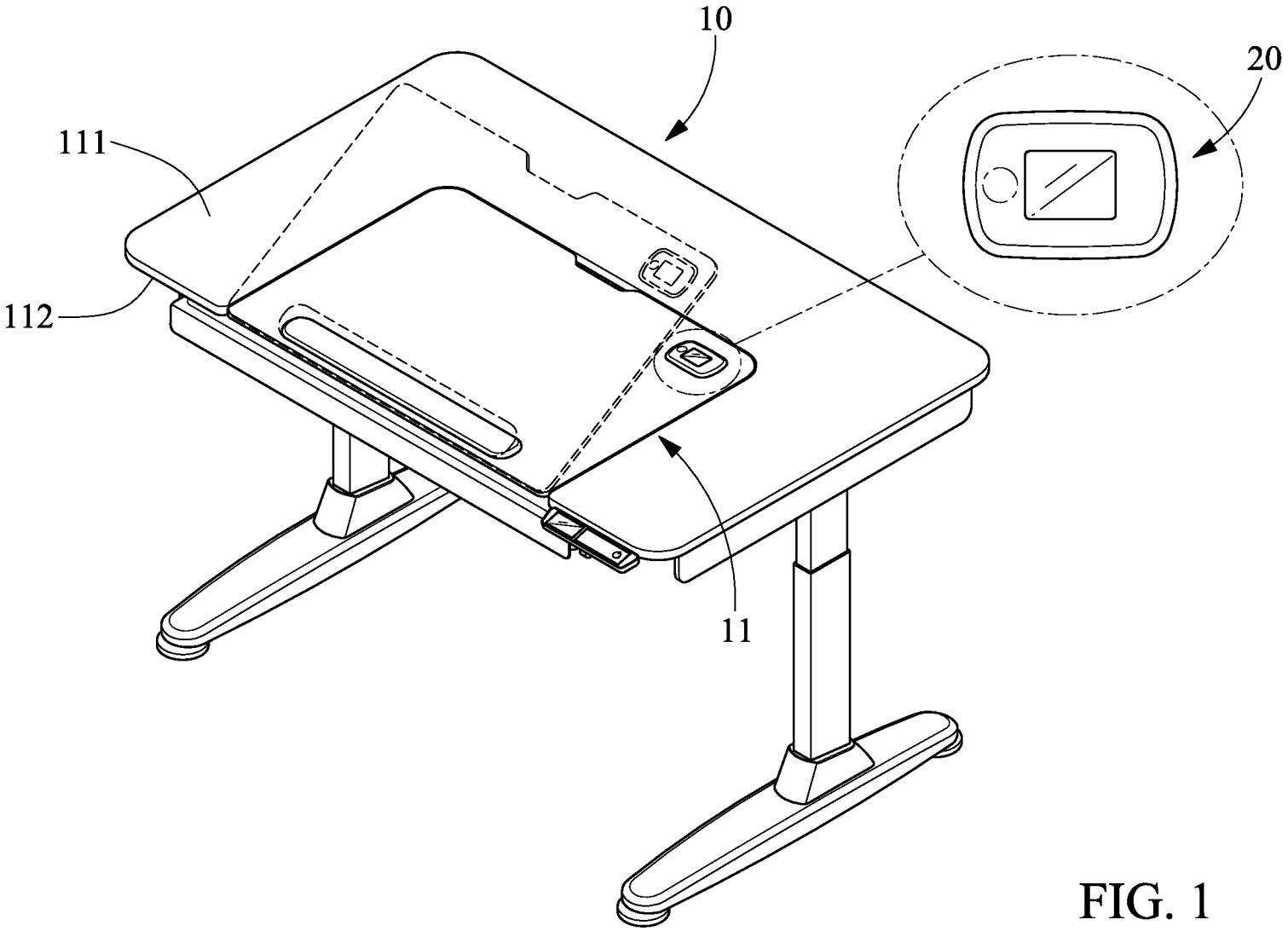
FIG. 1 is a perspective view of a table assembly that includes a tiltable board and an apparatus for attaching an inclination-monitoring device to the tiltable board according to the preferred embodiment of the present invention.
Figure 2:
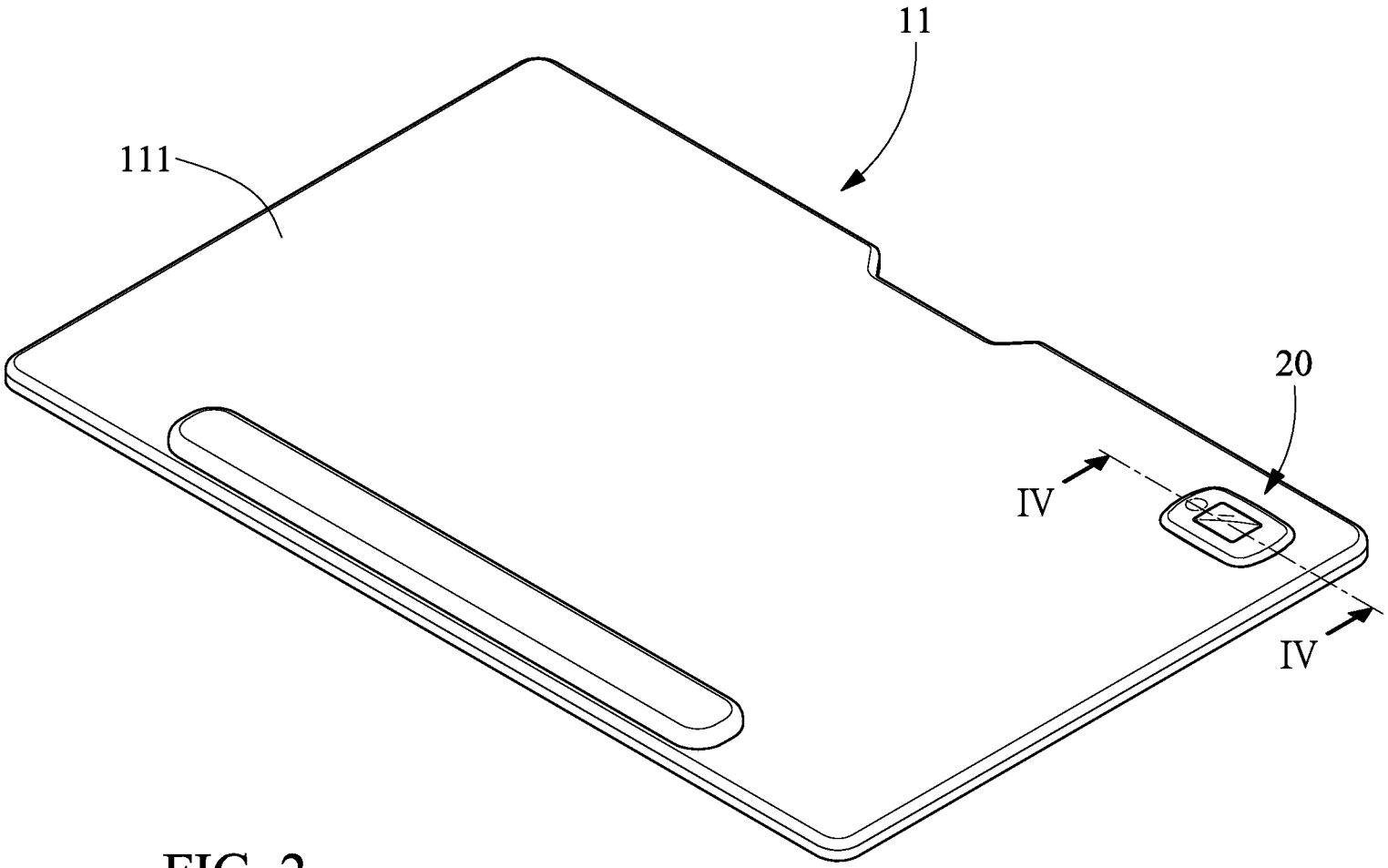
FIG. 2 is a perspective view of the tiltable board, the inclination-monitoring device and the attaching apparatus shown in FIG. 1.
Figure 3:
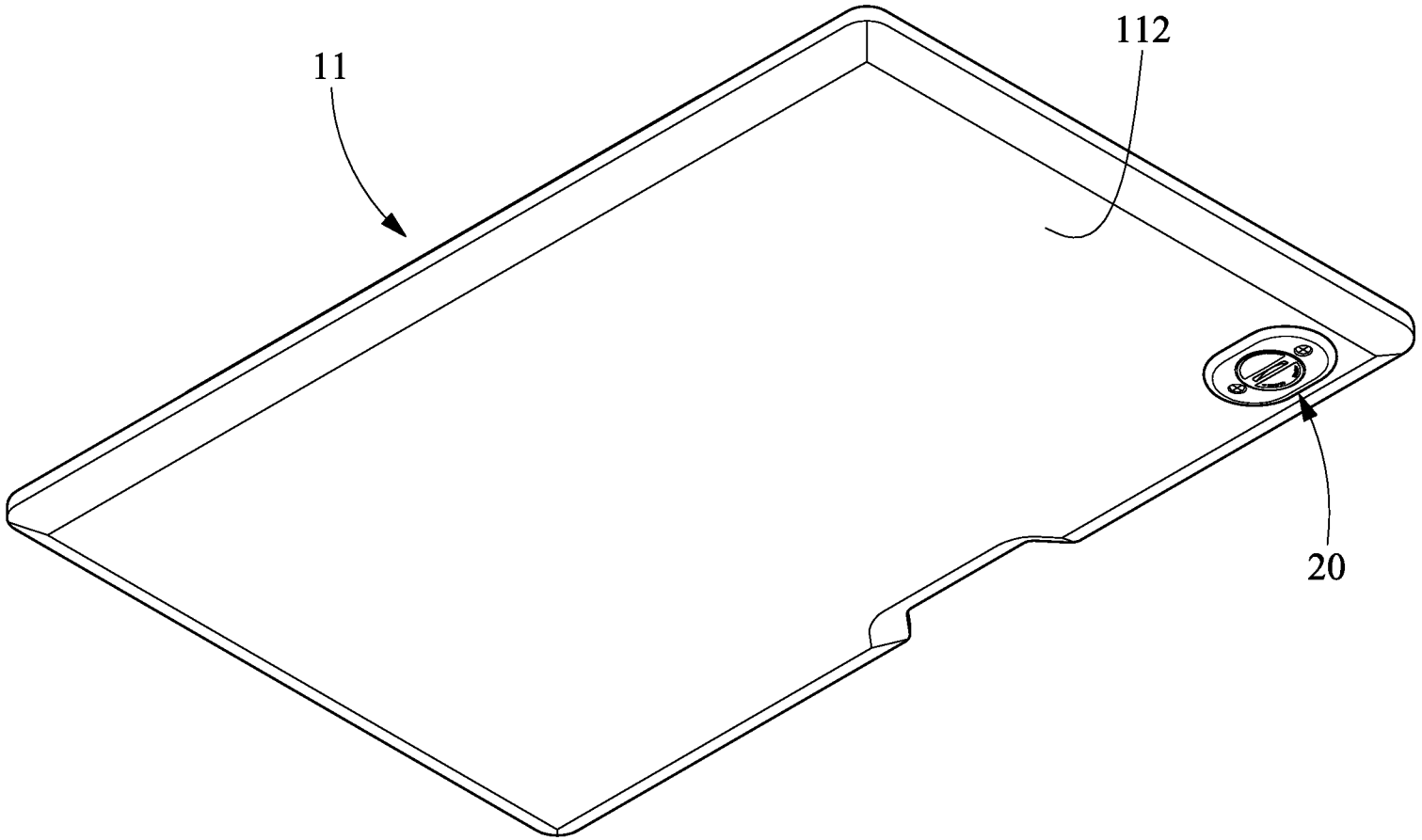
FIG. 3 is another perspective view of the tiltable board, the inclination-monitoring device and the attaching apparatus shown in FIG. 2.
Figure 4:
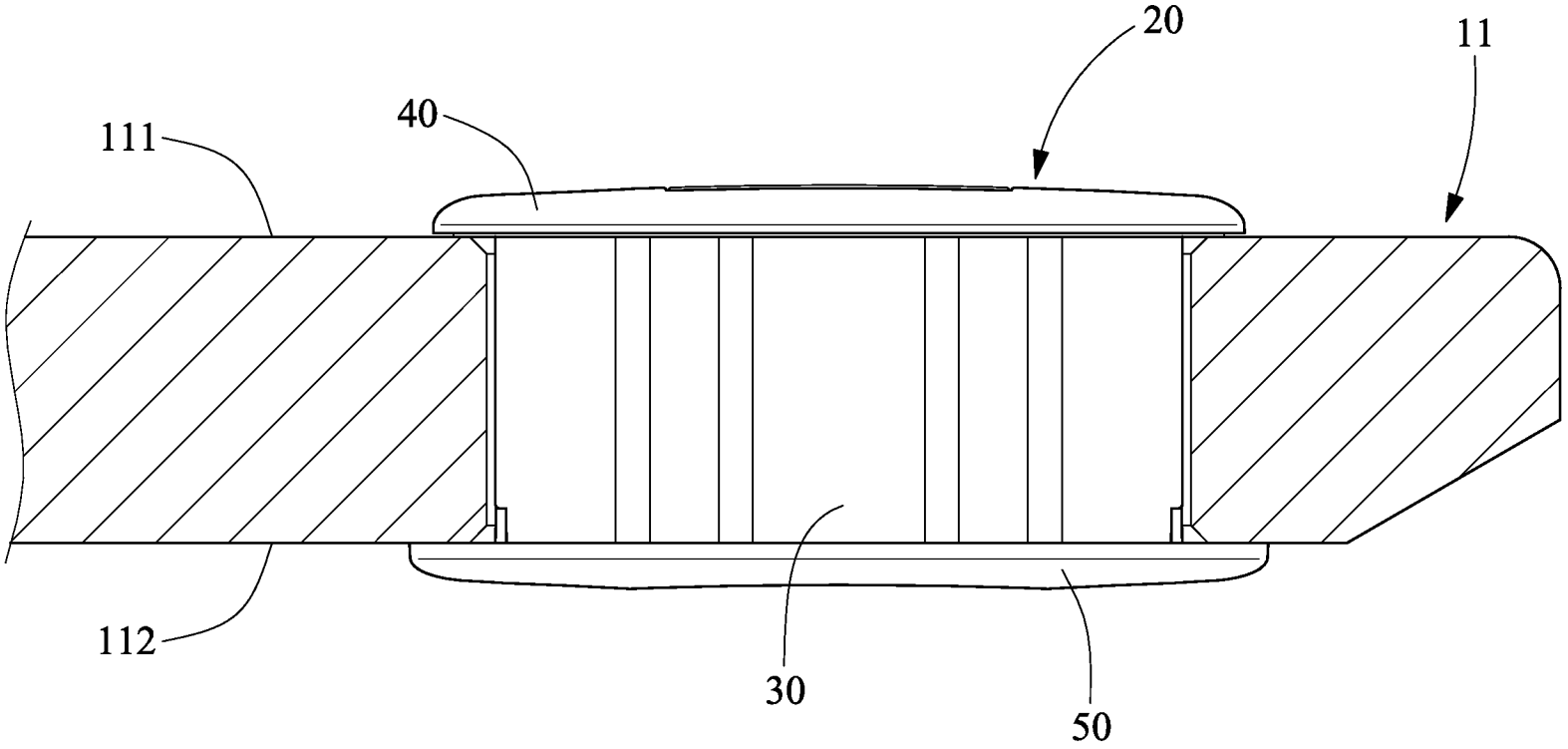
FIG. 4 is a cross-sectional partial view of the tiltable board, the inclination-monitoring device and the attaching apparatus shown in FIG. 1.

Referring to FIGS. 1 through 3, a table assembly 10 includes a tiltable board 11 pivotally connected to a table (not numbered) so that the inclination of the tiltable board 11 is changeable while the inclination of the table is kept at a certain angle. The tiltable board 11 is formed with an upper face 111 and a lower face 112.

The table assembly 10 is equipped with an inclination-monitor device 20 attached to the tiltable board 11 by an attaching apparatus according to the preferred embodiment of the present invention. The inclination-monitor device 20 detects and shows the inclination of the tiltable board 11.

Figure 5:
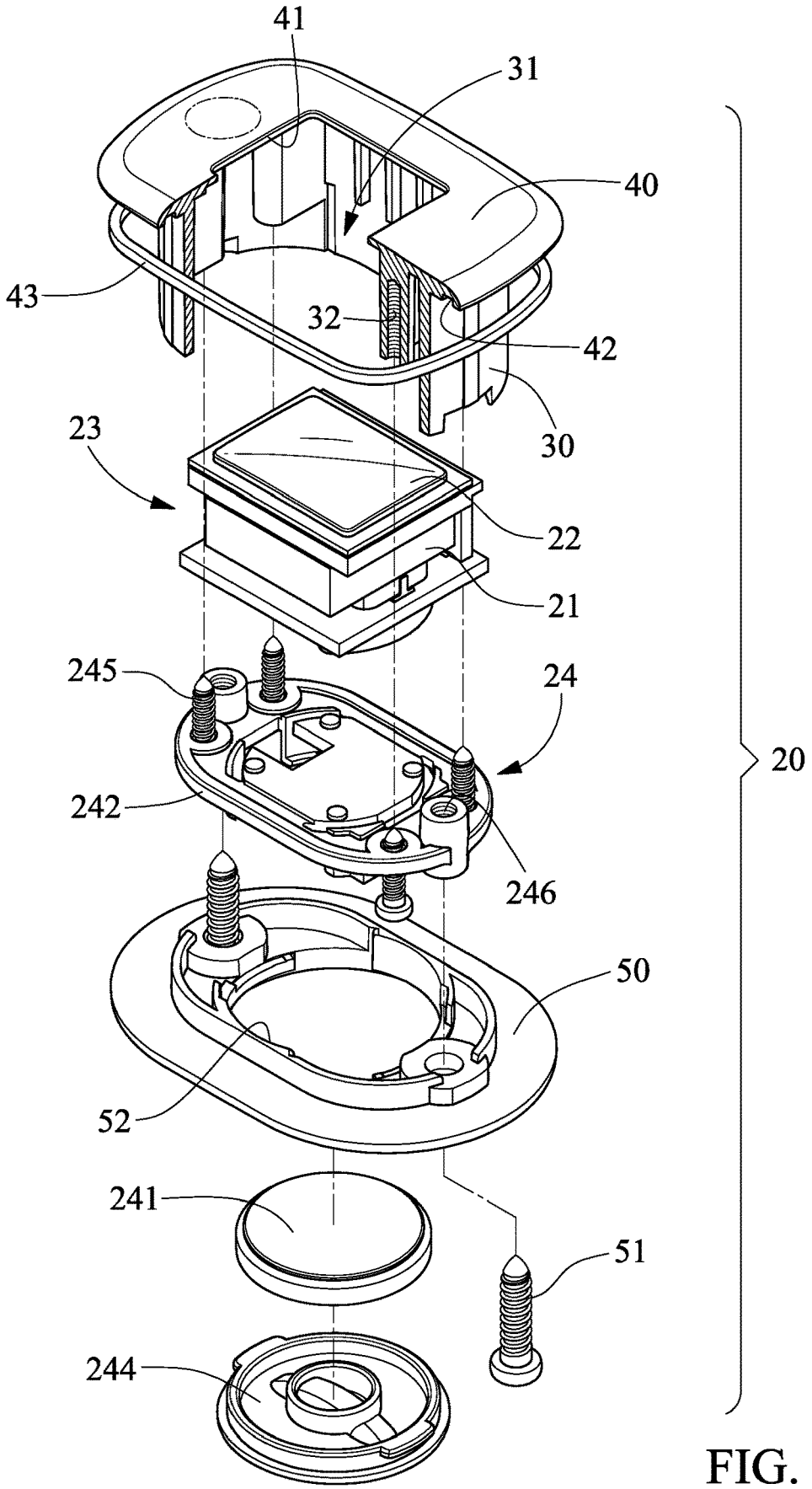
FIG. 5 is an exploded view of the inclination-monitoring device and the attaching apparatus shown in FIG. 1.
Figure 6:
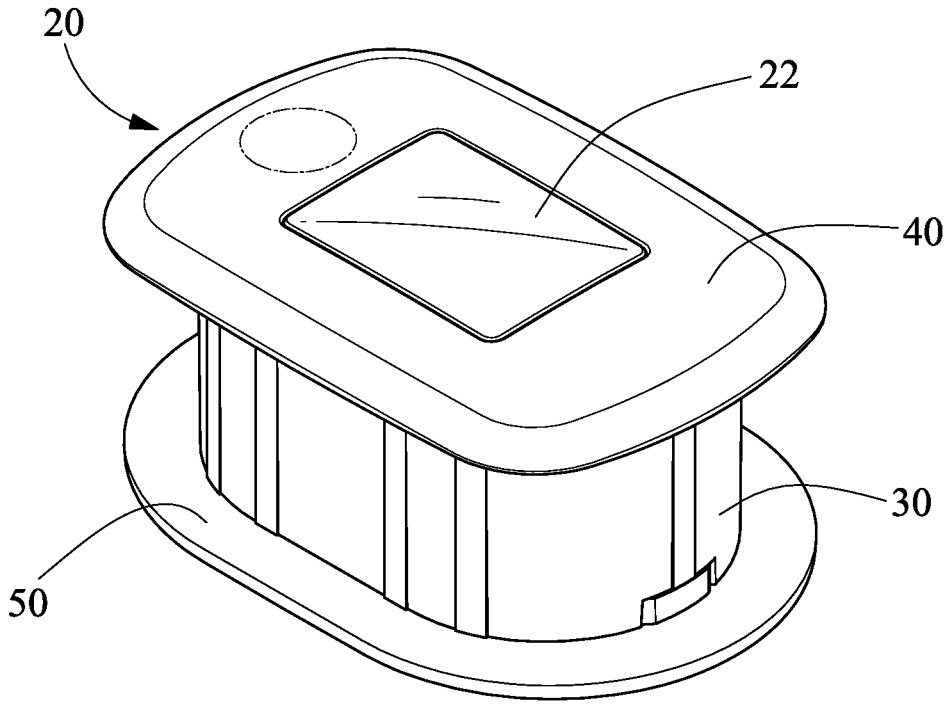
FIG. 6 is a perspective view of the inclination-monitoring device and the attaching apparatus shown in FIG. 5.
Figure 7:
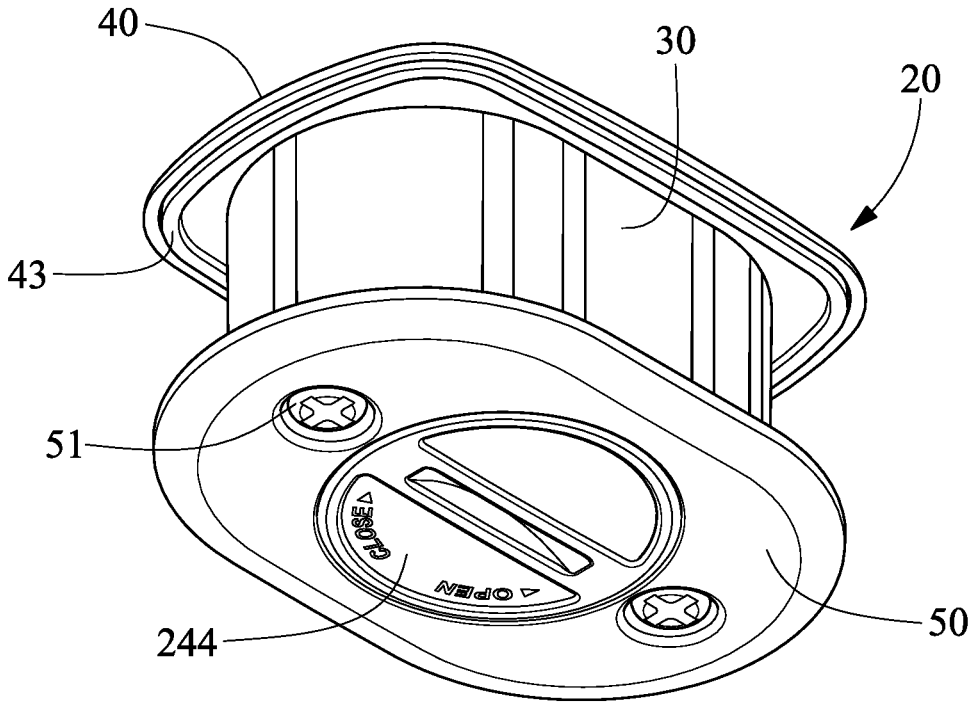
FIG. 7 is another perspective view of the inclination-monitoring device and the attaching apparatus shown in FIG. 6.
Figure 8:
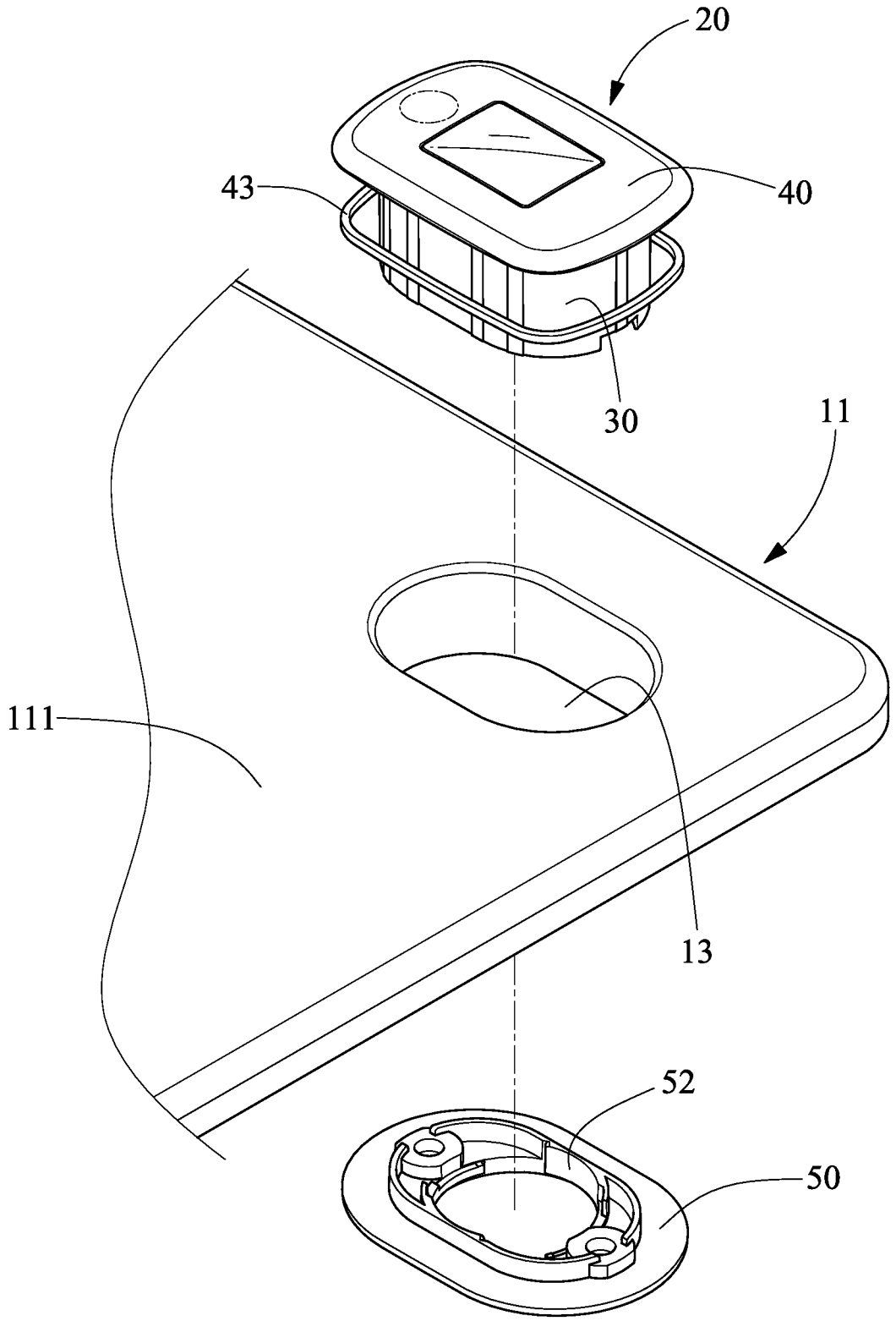
FIG. 8 is a perspective view of the inclination-monitoring device before it is attached to the tiltable board by the attaching apparatus of FIG. 1.

Referring to FIGS. 5 to 7, the inclination-monitor device 20 includes an electronic module 23 and a power supply 24. The electronic module 24 includes a sensor 21 and a display 22 connected to other electronic elements. The sensor 21 detects the inclination of the tiltable board 11 and sends a signal about the inclination. The sensor 21 includes a gyro for example. However, the sensor 21 is not limited to the gyro. The display 22 receives the signal and accordingly displays the inclination. The electronic elements include at least wireless-communication elements in communication of signals with a portable device such as a smart phone in a wireless manner. However, the electronic elements are not limited to the wireless-communication elements. The smart portable device runs various applications for communication of signals with the inclination-monitor device 20 to allow the smart portable device access to the inclination of the tiltable board 11, which is detected by the inclination-monitor device 20.

Figure 9:
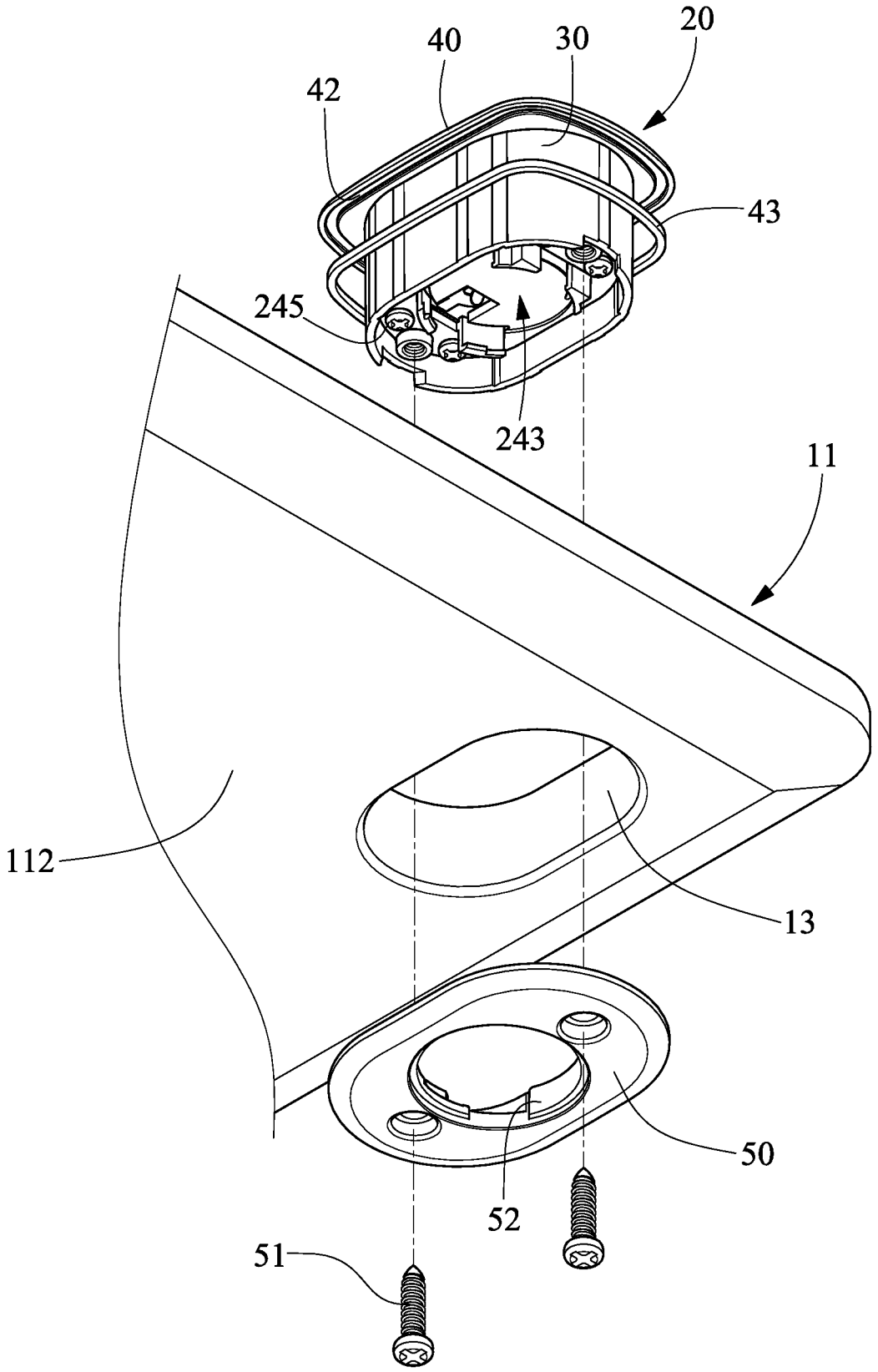
FIG. 9 is another perspective view of the inclination-monitoring device before it is attached to the tiltable board by the attaching apparatus shown in FIG. 8.
Figure 10:
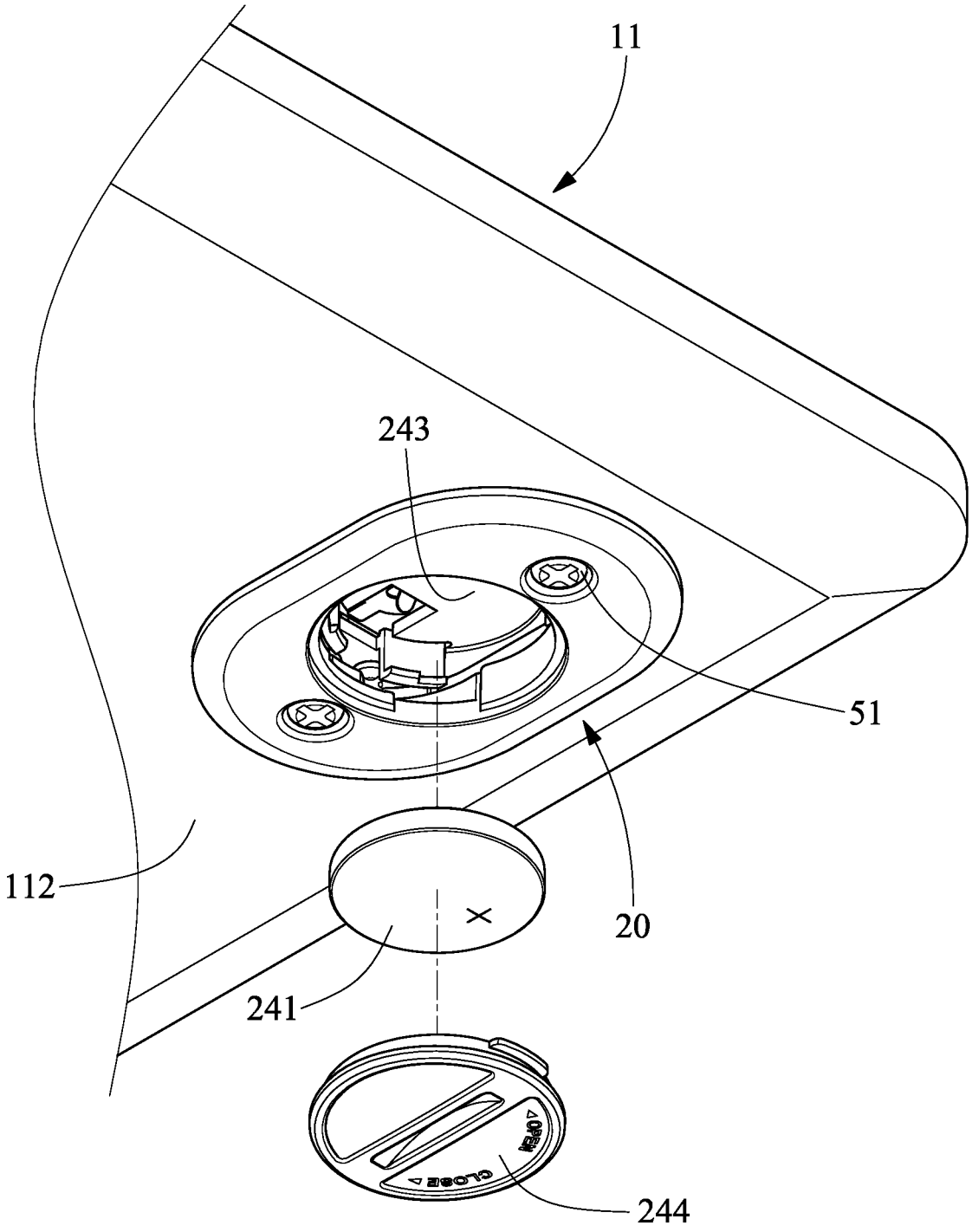
FIG. 10 is a perspective view of the tiltable board, the inclination-monitoring device and the attaching apparatus in another position than shown in FIG. 9.

The power supply 24 is electrically connected to the electronic module 23. The power supply 24 includes a battery 241, a holder 242 and a cover 244. The battery 241 is preferably a mercury battery (sometimes referred to as the "button cell" for its shape). The holder 242 includes a recess 243 in a lower face (FIGS. 9 and 10) and screw holes 246 located about the recess 243. The recess 243 is used to receive the battery 241. The cover 244 includes two wins (not numbered) for engagement with two flanges (not numbered) of the holder 242 that extend about the recess 243.

The attaching apparatus includes a shell 30, an upper frame 40 and a lower frame 50. The shell 30 includes a chamber 31 and several screw holes 32 located around the chamber 31. The chamber 31 is used to receive the inclination-monitor device 20. The screw holes 32 are used to receive several screws 245 that extend through several apertures (not numbered) made in the holder 242. Thus, the holder 242 is connected to the shell 30, below the electronic module 23. The electronic module 23 is kept in the chamber 31 by the holder 242.

The upper frame 40 is formed on the shell 30. The upper frame 40 extends from the shell 30 like a flange. The upper frame 40 includes an window 41 in communication with the chamber 31. Thus, the display 22 is exposed from the window 41 when the electronic module 23 is located in the chamber 31. The upper frame 40 preferably includes a annular groove 42 in a lower face, around the shell 30. An annular seal 43 is fitted in the annular groove 42.

The lower frame 50 includes an opening 52 and apertures (not numbered) located about the opening 52. Screws 51 are inserted in the screw holes 246 through the apertures of the lower frame 50. Thus, the lower frame 50 is connected to the holder 242. Moreover, the opening 52 is in communication with the recess 243 to allow smooth movement of the battery 241 into or from the recess 243 through the opening 52.

Referring to FIGS. 4 and 8 to 10, the electronic module 23 is located in the shell 30. The shell 30 is located in a bore 13 made in the tiltable board 11, and so is the electronic module 23. The upper frame 40 is located on the tiltable board 11 so that the annular seal 43 is in contact with the upper face 111 of the tiltable board 11. Then, the lower frame 50 is attached to the holder 242 below the tiltable board 11. A lower face of the lower frame 50 is in contact with the lower face 112 of the tiltable board 11. The battery 241 is located in the recess 243 of the holder 242 through the opening 52 of the lower frame 52. Finally, the cover 244 is engaged with the holder 242 to keep the battery 241 in the recess 243 and electrically connected to the electronic module 23.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A table assembly comprising:
- a tiltable board, configured to be pivotally connected to a table, and comprising an upper face, a lower face and a bore;
- an inclination-monitor device comprising:
  - an electronic module comprising:
    - a sensor for detecting the inclination of the tiltable board relative to the table and accordingly sending a signal; and
    - a display for receiving the signal and accordingly showing the inclination of the tiltable board relative to the table;
  - a power supply comprising:
    - a holder comprising a recess;
    - a battery located in the recess and electrically connected to the electronic module; and
    - a cover engaged with the holder to keep the battery in the recess; and
- an attaching apparatus comprising:
  - a shell located in the bore and formed with a chamber for receiving the inclination-monitoring device;
  - an upper frame extending on the shell, contacting the upper face of the tiltable table, and comprising a window in communication with the chamber so that the display showing the inclination of the tiltable board is exposed by the window; and
  - a lower frame for covering the holder and a portion of the lower face of the tiltable board around the bore, wherein the lower frame comprises an opening in communication with the recess to allow smooth movement of the battery into and from the recess via the opening.

2. The table assembly according to claim 1, further comprising a seal connected to a lower face of the upper frame and abutted against the tiltable table.

3. The table assembly according to claim 2, wherein the upper frame comprises a groove for receiving the seal.

4. The table assembly according to claim 1, wherein the shell further comprises screw holes for receiving screws extending through the holder to connect the holder to the shell.

5. The table assembly according to claim 1, wherein the lower frame is connected to the holder and abutted against the lower face of the tiltable board.

6. The table assembly according to claim 5, wherein the holder comprises screw holes for receiving screws extending through the lower frame.

7. The table assembly according to claim 1, wherein the battery is a mercury battery.

* * * * *